United States Patent [19]

Wilson et al.

[11] 4,050,725

[45] Sept. 27, 1977

[54] LATCH ASSEMBLY

[75] Inventors: William Crawford Wilson; David Bowen Anderson, both of Rochester, N.Y.

[73] Assignee: Eastman Kodak Company, Rochester, N.Y.

[21] Appl. No.: 671,531

[22] Filed: Mar. 29, 1976

[51] Int. Cl.[2] ..... E05C 21/00

[52] U.S. Cl. ..... 292/304; 292/341.19

[58] Field of Search ..... 292/30, 304, 341.18, 292/341.19, 341.12, DIG. 14

[56] References Cited

U.S. PATENT DOCUMENTS

| | | | |
|---|---|---|---|
| 2,031,302 | 2/1936 | Clark | 292/304 |
| 2,034,971 | 3/1936 | Brockway | 292/DIG. 14 X |
| 2,270,053 | 1/1942 | Hill et al. | 292/DIG. 14 X |
| 2,329,348 | 9/1943 | Honig | 292/304 X |
| 2,622,907 | 12/1952 | Hynes | 292/304 X |
| 2,793,061 | 5/1957 | Dall | 292/DIG. 14 X |
| 3,026,132 | 3/1962 | Korab et al. | 292/DIG. 14 X |

FOREIGN PATENT DOCUMENTS

| | | | |
|---|---|---|---|
| 8,941 | 4/1956 | Germany | 292/DIG. 14 |

*Primary Examiner*—Robert W. Saifer
*Attorney, Agent, or Firm*—Lawrence P. Kessler

[57] ABSTRACT

A latch assembly which both selectively latches and accurately positions separable members relative to one another. The latch assembly includes pawls pivotably mounted on a first member, the first member being biased toward a separated position relative to a second member. The pawls, which are biased toward a latched position, are interconnected by a handle for selectively urging the pawls toward an unlatched position. The first member supports guide pins adjacent to the pawls, the guide pins having a positioning flange located thereon. The second member carries latching posts having a recess for receiving the guide pins and a shoulder accurately positionable relative to the second member. The shoulders have oppositely facing surfaces, one surface engageable by the flange of the guide pin and the other by a latching surface of the pawl when the first member is in its latched position. A compression spring located on the guide pins between the flange and the first member urges the members in the direction of separation when the surfaces of the shoulder are engaged by the flange and the latching surface of the pawl to effect positive latching action therebetween.

5 Claims, 4 Drawing Figures

LATCH ASSEMBLY

BACKGROUND OF THE INVENTION

1. Field of the Invention

This invention relates generally to a latch assembly and more particularly to a mechanism for selectively latching and accurately positioning relatively separable members.

2. Description of the Prior Art

The need for selective latching mechanisms for separable members has long been known. Mechanisms proposed to accomplish this end have been as simple hook-and-eye assemblies and as complex as intricate linkage arrangements with remote lever release controls. In general, however, the prior art latches have been concerned only with selectively retaining separable members together; holding a critical spacing between the latched members has not been of particular consideration. When clearance between the separable members has been desired, it is usually accomplished by stops provided directly on one of the particular members being latched.

There has recently been disclosed in U.S. patent application Ser. No. 647,683, filed Jan. 8, 1976 which is a continuation of Ser. No. 523,610 filed Nov. 13, 1976 and now abandoned in the name of M. J. Russel, a document feeding apparatus which feeds sheets across the glass platen of an electrophotographic copier. The relative spacing between feeding apparatus and the platen is critical to the proper feeding of the sheets across the platen; i.e., the spacing must be accurately controlled to enable the feeder to apply sufficient forces to the sheets to move the sheets across the platen, but not such forces as would damage the sheets. The feeding apparatus is pivotably movable to a position to overlie the glass platen but is biased toward a separated position to facilitate lifting thereof by an operator desiring access to the platen. Since, as noted, the platen is made of glass (and therefore subject to breakage), and further since there must be a clear path for sheet transport, it is not convenient to use conventional stops to provide the accurate location of the feeder relative to the platen.

SUMMARY OF THE INVENTION

Accordingly, this invention provides a latch assembly which both selectively latches and accurately positions separable members relative to one another. The latch assembly includes pawls pivotably mounted on a first member, the first member being biased toward a separated position relative to a second member. The pawls, which are biased toward a latched position, are interconnected by a handle for selectively urging the pawls toward an unlatched position. The first member supports guide pins adjacent to the pawls, the guide pins having a positioning flange located thereon. The second member carries latching posts having a recess for receiving the guide pins and a shoulder accurately positionable relative to the second member. The shoulders have oppositely facing surfaces, one surface engageable by the flange of the guide pin and the other by a latched surface of the pawl when the first member is in its latched position. A compression spring located on the guide pins between the flange and the first member urges the members in the direction of separation when the surfaces of the shoulder are engaged by the flange and the latching surface of the pawl to effect positive latching action therebetween.

BRIEF DESCRIPTION OF THE DRAWINGS

In the detailed description of the preferred embodiment of the invention presented below, reference will be made to the accompanying drawings, in which.

DESCRIPTION OF THE PREFERRED EMBODIMENTS

Figure 1:
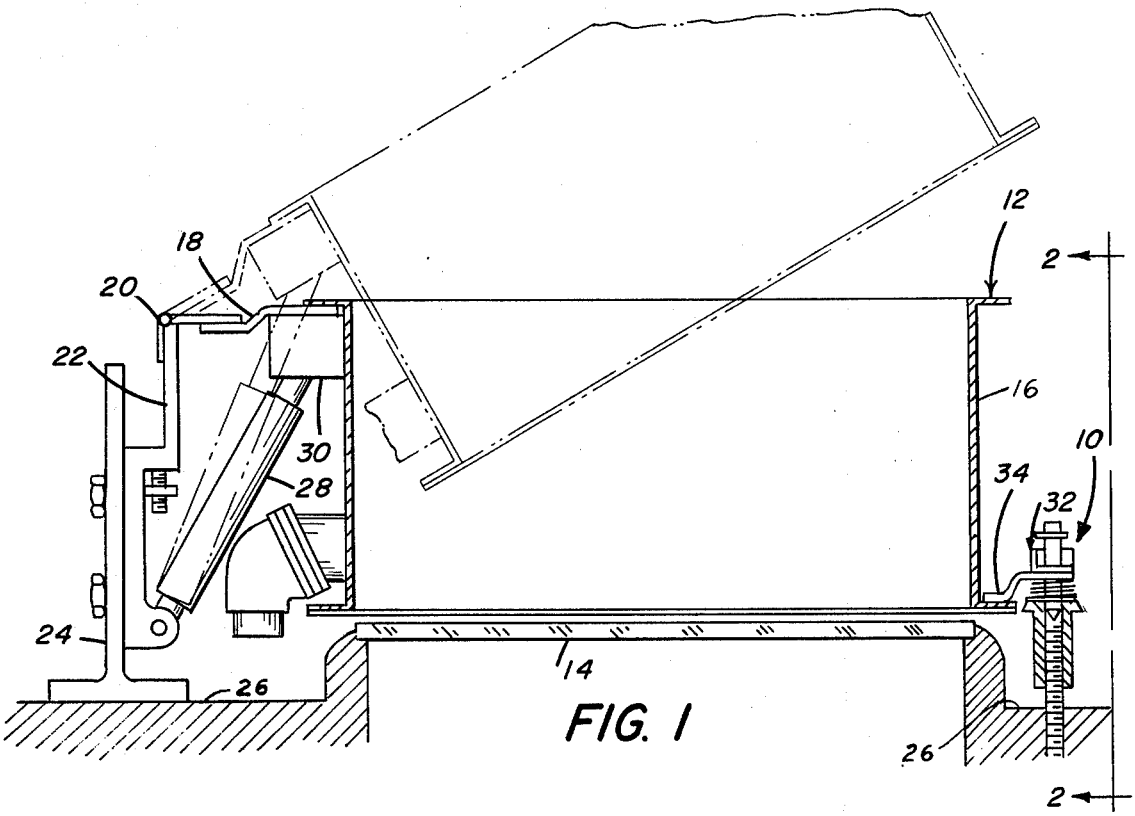
FIG. 1 is a side elevational view, partly in section, of a document feeder accurately held in its latched position relative to the platen of an electrophotographic copier by the latching assembly according to this invention (the feeder being shown in its non-operative position in phantom lines)

Referring now to the drawings, a latch assembly 10 is shown in FIG. 1 for latching and accurately positioning a document feeder 12 with respect to a glass platen 14 of an electrophotographic copier. It should, of course, be understood at the outset that use of the latch assembly 10 to latch the document feeder 12 in position relative to the platen 14 as described is intended only as an illustrative example for in fact the latch assembly 10 of this invention can be used to latch and accurately position other relatively separable members. The feeder 12 has a housing 16 within which the document feeding mechanism is contained. As for the details of the document feeding mechanism per se, such structure is fully set forth in aforementioned U.S. patent application Ser. No. 647,683, and is repeated herein only to the extent necessary for a complete understanding of the instant invention.

The housing 16 has a top bracket 18 which is connected through a hinge 20 to a vertical support casting 22. The casting 22 is in turn connected to a bracket 24 fixed to the base 26 of an electrophotographic copier. Counter-balance pistons 28 (one shown), connected between the casting 22 and a fixture 30 connected to the top bracket 18, provide a dynamic force to urge the feeder 12 for movement in a counterclockwise direction about the hinge 20 to the position shown in phantom lines in FIG. 1 (feeder and the glass platen 14 are in a separated non-operative position). The bias of the feeder 12 toward its phantom line position is utilized to reduce the force required to raise the feeder when access to the platen 14 is desired.

Figure 4:
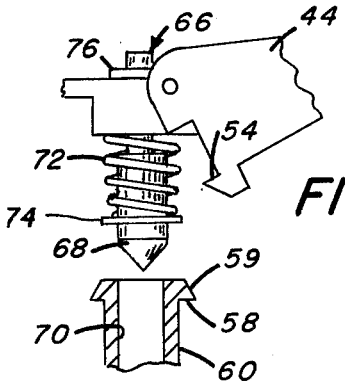
FIG. 4 is a front elevational view of a portion of the latch assembly of FIG. 2 but with the assembly in its un-latched position.

The latch assembly 10 includes a carriage 32 for supporting the latching elements of the assembly. The carriage 32 is fixed, by fasteners 36 (see FIGS. 2 and 4), to a front bracket 34 extending outwardly from the feeder housing 16 on the side opposite the bracket 24. Particularly the carriage 32 supports a pair of oppositely facing pivotable pawls 38, the pawls 38 each having a base 42 supporting upstanding side-walls 44 and 46 straddling the carriage 32 (see FIG. 3). Pins 40, fixed to the carriage 32, pass through the side-walls 44 and 46 to provide a pivot for the pawls 38. The pawls 38 are biased toward a latched position by a resilient compression spring 48 interposed between the base 42 of the pawls and the carriage 32. A post 50 fixed to the base 42 of each of the pawls 38, extends substantially vertically through a respective enlarged opening 52 in the carriage 32. The posts serve to locate the springs 48 to provide the desired biasing action on the pawls.

The pawls 38 have a latching surface 54 which extends between the side-walls 44 and 46. The latching surface 54 is positioned substantially directly beneath the respective pin 40 about which the pawl 38 pivots. The location of the latching surface 54 radially beneath the pin 40 prevents premature unlatching as a result of counter-rotational forces on the pawl 38 when in its latched position. A pair of posts 60, mounted on the electrophotographic copier have shoulders 59, the underside surface 58 thereof serving as complimentary latching surfaces for the latching surfaces 54 of the pawls 38. The posts 60 are supported on threaded studs 62, which are adjustable so that the location of the point of contact of the surfaces 54 and 58 (and thus the position of feeder 12) can be accurately set vertically relative to the platen 14. When the posts 60 are properly positioned on the studs 62, they may be retained by set screws 64.

Figure 2:
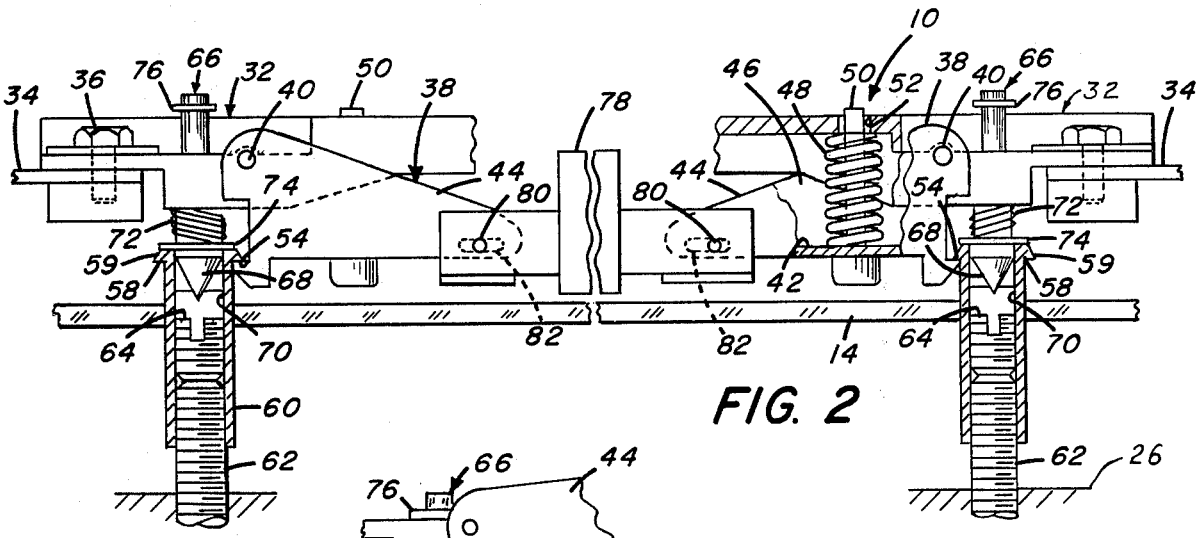
FIG. 2 is a front elevational view of the latch assembly of this invention, the assembly being in its latched position.
Figure 3:
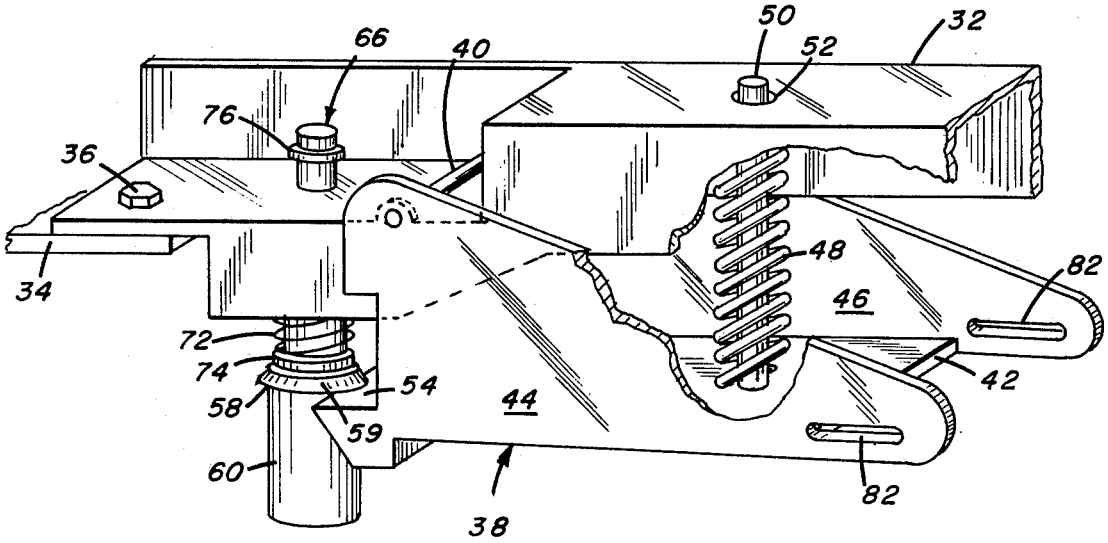
FIG. 3 is a perspective view of one of the pawl members of the latch assembly of FIG. 2, with parts broken away to facilitate viewing.

The carriage 32 also supports a pair of guide pins 66 for limited vertical movement with respect to the carriage. The guide pins 66 have a conically shaped lead end 68, which upon entering the bore 70 of respective posts 60. The guide pins 66 and the bores 70 are sized to have a mating relationship as seen in FIG. 2, to laterally position the carriage 32 (and thus the feeder 12) relative to the platen 14. The guide pins 66, which are retained in the carriage by retainer rings 76, carry a compression spring 72 located between the carriage 32 and a flange 74 fixed to the pins. The spring 72 applies a resilient biasing force between the carriage 32 and the flange 74. When the carriage 32 is in its latched position as shown in FIG. 2, with the latching surfaces 54 engaged with the surfaces 58, the springs 72 are compressed to maintain the flanges 74 in engagement with the top surface of the shoulders 59. Thus the spring 72, along with the biasing forces of the counterbalancing pistons 28, urge the carriage 32 upwardly to maintain the surfaces 54 and 58 securely latched and to maintain the accurate position of the carriage 32 with respect to the platen 14.

In order to release the latch assembly 10 so that the feeder 12 may move to its non-operative position (phantom lines of FIG. 1), a center-pull release handle 78 is connected to the pawls 38 through pins 80. The pins 80 pass through slots 82 in the side walls 44, 46 of the pawls 38. When the handle 78 is lifted, the pins 80 will exert an upward force on the pawls 38. The pawls 38 will rotate about their respective pins 40 to move the latching surfaces 54 and 58 apart thus moving the pawls to their unlatched position of FIG. 4. The pins 80 are free to move laterally in the slots 82 to accommodate the varying radial distances between the pins 80 and the pins 40 as the pawls 38 rotate. When the pawls 38 have pivoted to a degree to permit the latching surfaces 54 to completely disengage the shoulders 59, the springs 72 will cause the carriage 32 to raise relative to the pins 66 so that the pawls 38 will clear the posts 60. The counterbalance pistons 28, with operator assistance, will then move the feeder 12 to its non-operative position of FIG. 1.

From the foregoing it is apparent that there is herein provided a latch assembly which both selectively latches and accurately positions separable members relative to one another. A carriage fixed to one of the members supports pivotable pawls, biased toward a latched position, and guide pin adjacent to each pawl. Latching posts mounted on the other separable member receive the guide pins when the members are moved to the latched position to laterally position the separable members. The posts have shoulders engageable on one surface by the pawls and on the opposite surface by a flange located on the guide pins. The shoulders of the posts are accurately positionable to permit a desired spatial relationship to be maintained between the separable members.

The invention has been described in detail with particular reference to preferred embodiment thereof, but it will be understood that variations and modifications can be effected within the spirit and scope of the invention.

We claim:

1. Latching assembly for selectively latching and accurately positioning a frame relative to a frame support, said frame and said frame support being biased from a latched position toward a separated position, said assembly comprising:

at least one pawl pivotably mounted on said frame, said pawl having a latching surface for latching said frame to said frame support; means to bias said pawl to a latched position; means connected to said pawl for selectively moving said pawl to an unlatched position; at least one guide pin mounted on said frame for extensible movement relative thereto, resilient means for urging said pin to a position extending from said frame, a positioning flange fixed to said guide pin; at least one latching post fixed to said frame support, said latching post having a recess sized for matingly receiving said one guide pin for laterally positioning said frame relative to said support when said members are moved toward their latched position and further having an adjustable shoulder, said shoulder having a first surface engageable by said positioning flange and a second surface engageable by said latching surface of said pawl when said frame is in its latched position relative to said frame support whereby said frame is securely latched and accurately spatially positioned relative to said frame support.

2. The structure of claim 1 wherein said at least one guide pin has a conical shaped lead end whereby when said lead end enters said recess in said latching post said frame may be laterally positioned relative to said frame support.

3. The structure of claim 1 wherein said latch assembly includes a pair of pawls and wherein said means for moving said pawl to their unlatched position includes a center-pull handle connected to said pawls to act in unison on said pawls when it is desired to move said pawls to the unlatched position.

4. The structure of claim 3 wherein said latch assembly includes a pair of latching posts, said posts being mounted on threaded studs so as to enable said shoulder thereof to be accurately located relative to said frame support.

5. A latch for separable members comprising:

a post adjustably mounted in one of the members, said post having an annular shoulder on one end defining an opening in the post, one surface of the shoulder forming a positioning surface and another surface on the opposite side of the shoulder from said one surface forming a latching surface, means for adjusting said post to selectively position said annular shoulder in precisely spaced relation from said one member;

a locating guide pin mounted in the other of said members for extensible movement relative thereto, said pin being in alignment with said post and dimensioned to mate with said opening of said annular members when in their latched position, resilient means for urging said pin to a position extending from said other of said members said pin having an integral positioning flange for abutting said positioning surface of said shoulder when the pin is disposed in said opening to spatially locate said separable members when in their latched position;

a pawl having a latching surface for engaging said latching surface of said shoulder, said pawl including means for mounting said pawl on said other member for pivotal movement relative to said other member about an axis which is parallel to the latching surface when engaged with the latching surface of said post; and means positioned between said flange of said guide pin and said other member for resiliently urging said other member in the direction of separation of said members when said latching and positioning surfaces of said shoulder are engaged by said latching surface of said pawl and said flange respectively to effect a positive latching action and accurate spatial positioning therebetween.

* * * * *